US006896511B2

(12) United States Patent
Chadha

(10) Patent No.: US 6,896,511 B2
(45) Date of Patent: May 24, 2005

(54) METHOD FOR INSERTING AN OBJECT INTO A CANDLE

(76) Inventor: Ajay Chadha, 1601 Applewood Way, Tallahassee, FL (US) 32312

( * ) Notice: Subject to any disclaimer, the term of this patent is extended or adjusted under 35 U.S.C. 154(b) by 0 days.

(21) Appl. No.: 10/458,529

(22) Filed: Jun. 10, 2003

(65) Prior Publication Data

US 2004/0253558 A1 Dec. 16, 2004

(51) Int. Cl.[7] ..... F23D 3/16
(52) U.S. Cl. ..... 431/289; 431/291
(58) Field of Search ..... 431/289, 288, 431/291, 126, 292; D26/6

(56) References Cited

U.S. PATENT DOCUMENTS

| | | | | |
|---|---|---|---|---|
| 3,744,956 A | | 7/1973 | Hess et al. | |
| 3,744,957 A | * | 7/1973 | Wright, Sr. | 431/126 |
| 3,983,677 A | | 10/1976 | Lundbom | |
| 4,028,045 A | * | 6/1977 | Reiher | 431/289 |
| 4,096,299 A | | 6/1978 | Stewart | |
| 4,225,552 A | | 9/1980 | Chang | |
| 4,696,640 A | * | 9/1987 | Pitchford | 431/289 |
| 4,826,428 A | | 5/1989 | Lam | |
| 5,395,233 A | | 3/1995 | Karp | |
| 5,632,615 A | | 5/1997 | DeGarmo | |
| 5,927,965 A | | 7/1999 | Pappas | |
| 6,033,210 A | | 3/2000 | Freeman | |
| 6,210,153 B1 | | 4/2001 | Freeman et al. | |
| 6,299,435 B1 | | 10/2001 | Freeman et al. | |
| 6,409,501 B1 | | 6/2002 | Pappas | |
| 6,428,753 B2 | * | 8/2002 | Freeman | 422/126 |
| 6,491,517 B2 | | 12/2002 | Freeman et al. | |

OTHER PUBLICATIONS

Westerman, "Gel Candle—40 Creative Projects" p. 12, 2001.*

* cited by examiner

*Primary Examiner*—James C. Yeung
(74) *Attorney, Agent, or Firm*—John Wiley Horton

(57) ABSTRACT

A process for adding objects to a candle. Methods are disclosed for adding an object before the fuel has assumed its final state and after the fuel has assumed its final state. Several related approaches for introducing the object are disclosed, including making an incision to insert the object, retracting the fuel away from its container in order to slip the object in between the fuel and the container, and creating a melted region in the fuel which will allow the object's insertion. Once the object is in place, the fuel is locally heated above its melting temperature in order to reflow the fuel around the object. The candle is then cooled so that the fuel transitions back into its normal state.

6 Claims, 7 Drawing Sheets

METHOD FOR INSERTING AN OBJECT INTO A CANDLE

BACKGROUND OF THE INVENTION

1. Field of the Invention

This invention relates to the field of candles. More specifically, the invention comprises a method for inserting an object into a candle.

2. Description of the Related Art

Candles have been used for illumination and other purposes for many centuries. FIG. 1 shows a decorative candle known in the art. Candle 10 includes jar 12 containing fuel 14 and wick 16. Fuel 14 can be many materials. In the field of decorative candles, a transparent jar and transparent combustible fuel (often a "jelly") are often used. The transparency allows objects placed within jar 12 to be viewed. As an example, decorative object 18 can be immersed in fuel 14 during the manufacturing process of the candle. The use of transparent fuel allows this decorative object to be viewed (Note that transparent fuels are often used even in the absence of decorative objects).

Numerous creative visual effects are possible. A variety of objects can be immersed to create a miniature scene within the candle. Metallic flakes or other objects of visual interest can be suspended within the fuel as well. Once the manufacturing process is complete, the fuel solidifies (though some fuels only harden to a Gel state). The candle is then in a complete form.

BRIEF SUMMARY OF THE INVENTION

The present invention comprises a process for adding objects to a candle. Methods are disclosed for adding an object before the fuel has assumed its final state and after the fuel has assumed its final state. Several related approaches for introducing the object are disclosed, including making an incision to insert the object, retracting the fuel away from its container in order to slip the object in between the fuel and the container, and creating a melted region in the fuel which will allow the object's insertion. Once the object is in place, the fuel is locally heated above its melting temperature in order to reflow the fuel around the object. The candle is then cooled so that the fuel transitions back into its normal state.

REFERENCE NUMERALS IN THE DRAWINGS

| | | | |
|---|---|---|---|
| 10 | candle | 12 | jar |
| 14 | fuel | 16 | wick |
| 18 | decorative object | 20 | personalizing object |
| 22 | text message | 24 | knife |
| 26 | incision | 28 | retractor |
| 30 | retracted cavity | 32 | melted region |
| 34 | solid region | 36 | upper surface |
| 40 | reflowed fuel | 42 | glue joint |

DESCRIPTION OF THE INVENTION

Figure 1:
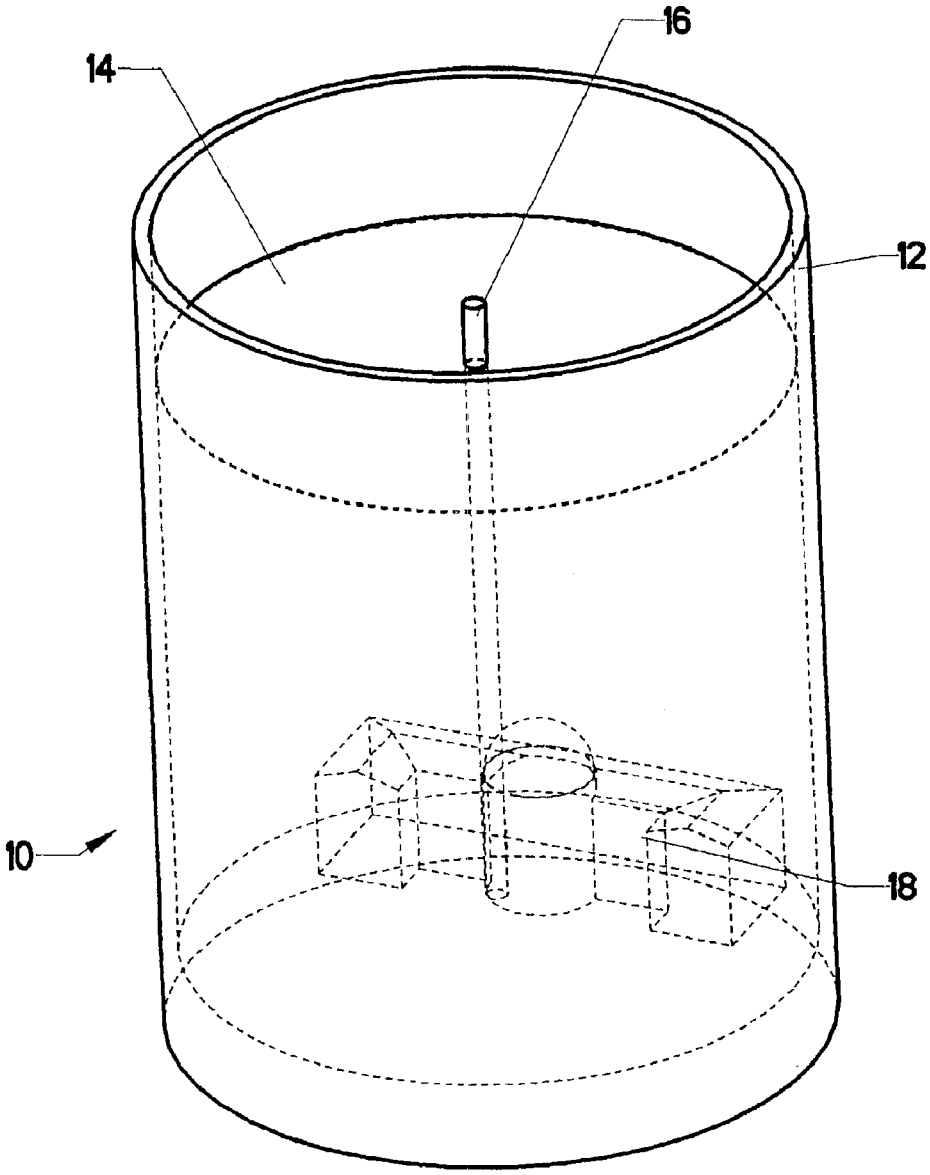
FIG. 1 (PRIOR ART)
FIG. 1 is an isometric view, showing a prior art decorative candle.
Figure 2:
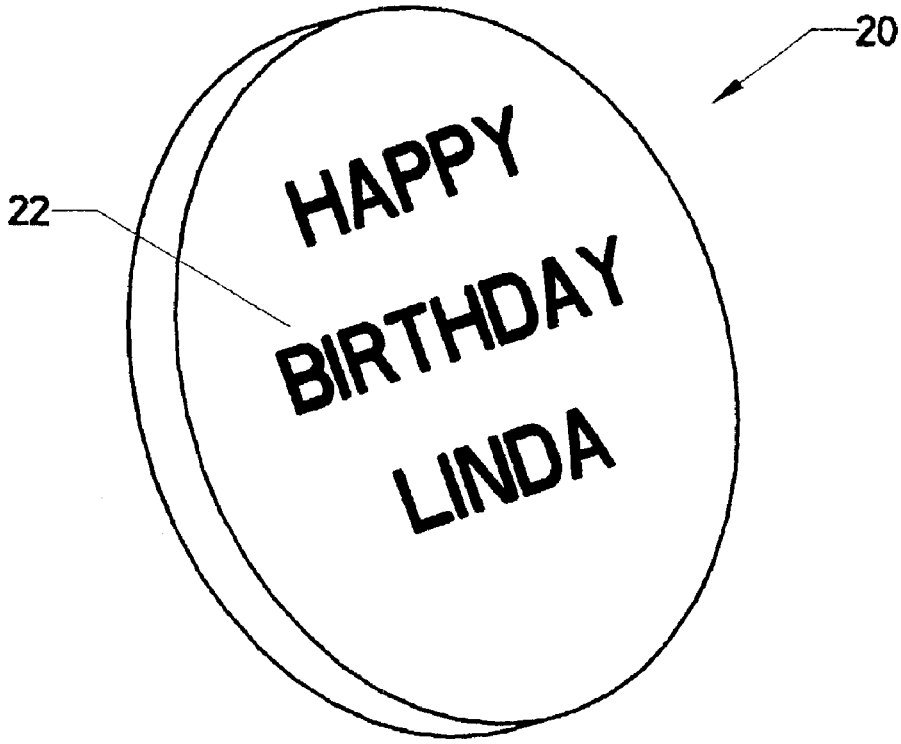
FIG. 2 is an isometric view, showing a personalizing object.

The primary object of the present invention is to add an object to a premanufactured candle. This operation is often done in order to "personalize" the candle to satisfy a purchaser's desires. A personalizing object can assume many forms. FIG. 2 shows personalizing object 20, which is a glass disk. Text message 22 has been etched or otherwise affixed to the surface of personalizing object 20. The object must then be placed into the decorative candle. The actual method of creating the text message can be any one of a number of techniques known in the art, including printing a a clear transparent label that is then adhered to the glass disk, hand printing the message of a label, etc.

Figure 3:
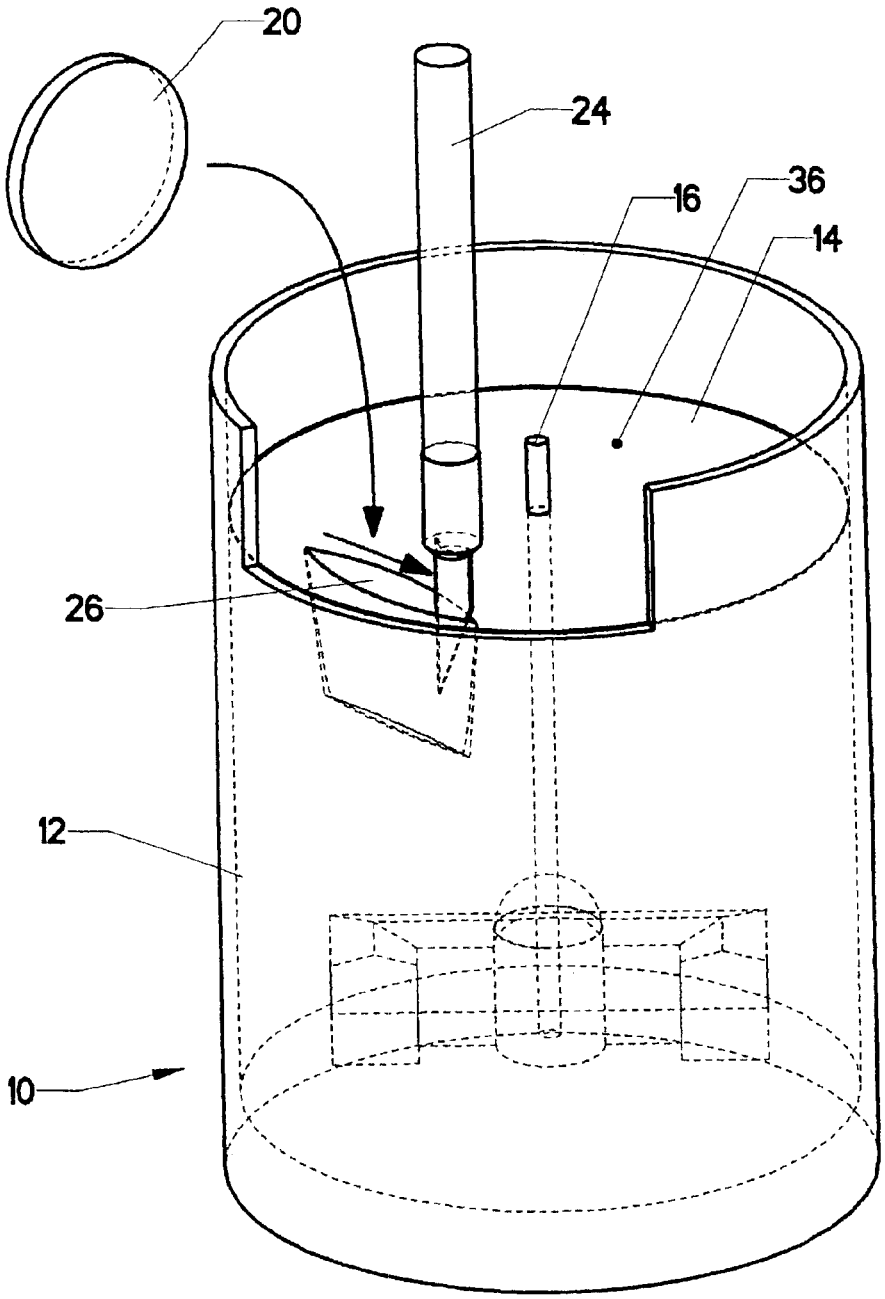
FIG. 3 is an isometric view with a cutaway, showing the insertion of a personalizing object.

FIG. 3 shows candle 10 from a different perspective. Knife 24 is used to cut incision 26 into upper surface 36 of fuel 14. Incision 26 is made deep enough to allow personalizing object 20 to be inserted into the incision (though not necessarily to be enclosed completely within the incision). Once personalizing object 20 is in place, it is preferable to reflow fuel 14 in order to remove the unsightly nature of incision 26. As stated previously, fuel 14 is preferably a combustible jelly. While solid at room temperature, it melts with the addition of moderate heat. It is possible to melt the jelly at a temperature well below its ignition temperature, so that there is little concern about igniting the fuel.

Figure 6:
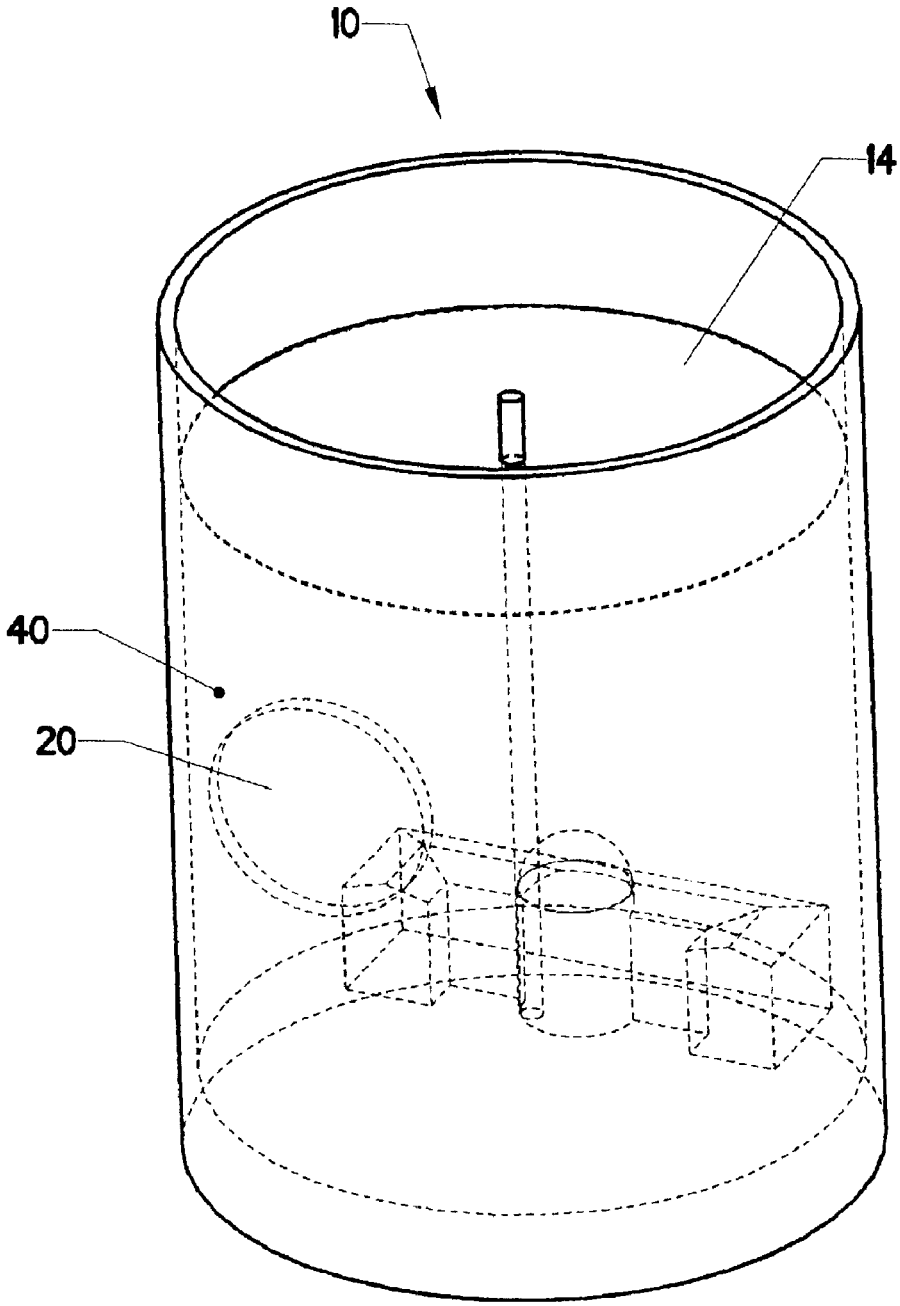
FIG. 6 is an isometric view, showing the completion of the process.

Once fuel 14 around incision 26 has been heated above its melting temperature, it will liquify and flow around personalizing object 20. Once allowed to cool, it will again solidify in a transparent state. Personalizing object 20 will be suspended within fuel 14. FIG. 6 shows the completed candle 10, with personalizing object 20 suspended within fuel 14.

The reheating of the fuel can be accomplished in a variety of ways. One simple approach is to apply a heat gun to the portion of jar 12 proximate incision 26. Conductive heat transfer will tend to melt the fuel only in proximity to the heat gun. Once the liquified wax has flowed around personalizing object 20 and closed incision 26, the heat gun is removed.

Another approach is to place candle 10 in a pot of hot water. The conductive heat transfer from the hot water will melt the portions of fuel 14 near jar 12 first, working its way inward. Once the liquified region has passed inside the location of incision 26, candle 10 is removed from the hot water.

A convective oven can likewise be used, with candle 10 being placed within the oven. The heat transferred to the candle liquifies the fuel from the outside working inward. A microwave oven can also be used, though it may be necessary to liquify all the fuel, since the heat will not be transferred from the outside in.

Finally, the candle can simply be placed atop a heat source, such as a "hot plate." This method is inefficient, since it tends to melt from the bottom up (meaning that the personalizing object likely cannot be inserted until all the fuel is melted). It does, however, take advantage of equipment that is widely available. Other known heating methods can be used as well.

In some instances, it may be desirable to rapidly cool the candle once the desired reflow has been achieved. This is particularly true where the personalizing object has a density significantly exceeding the density of the fuel. If a liquified region is created around the personalizing object, a dense personalizing object will begin to sink (Although, owing to the viscous nature of the fuel, it will not tend to sink very rapidly). It may then be desirable to rapidly cool the liquified region in order to arrest the downward movement of the personalizing object. Such rapid cooling can be accomplished via directing a jet of cold air onto the jar, immersing the candle in an ice water bath, or other prior art cooling methods. In many instances, however, the candle can be cooled satisfactorily by simply setting it aside and allowing it to cool slowly.

Figure 4:
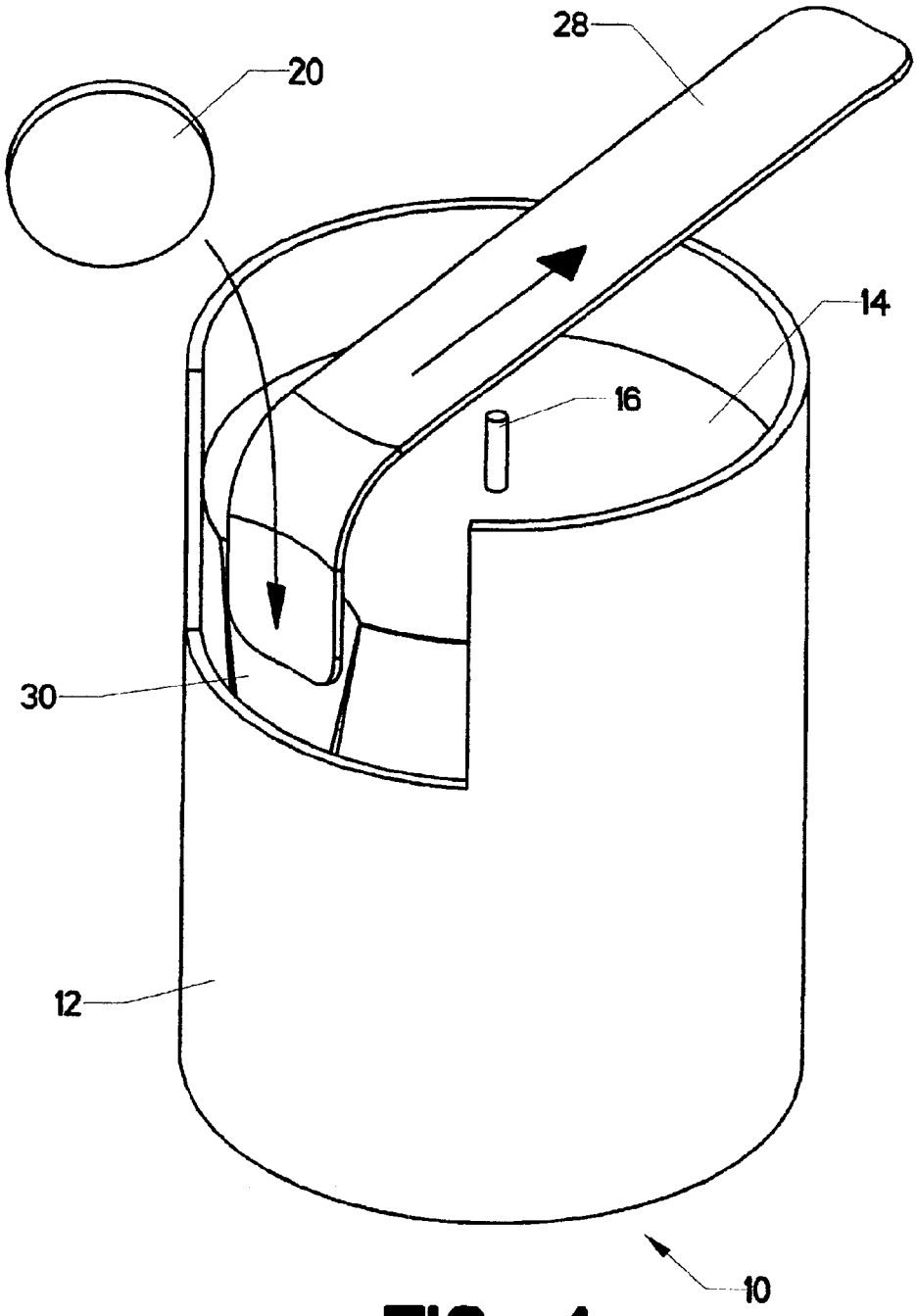
FIG. 4 is an isometric view with a cutaway, showing the insertion of a personalizing object.

Other methods can be used to introduce the personalizing object into the fuel. FIG. 4 shows one such alternate approach. Retractor 28 is inserted along the vertical wall of jar 12. A portion of fuel 14 is then pried away from jar 12 to create retracted cavity 30. Personalizing object 20 is then slipped into retracted cavity 30. Retractor 28 may then be removed, or it may remain through the reflow process (A user's fingers or other prying object can be substituted for retractor 28). A melted region is created around personalizing object 20 using any of the methods previously described. Once the fuel liquifies, it flows around personalizing object 20 and adheres once again to the wall of jar 12. The fuel is then allowed to cool (or forcibly cooled) until it turns back into a solid. The result is again the view shown in FIG. 6, with personalizing object 20 being completely immersed within fuel 14.

Figure 5:
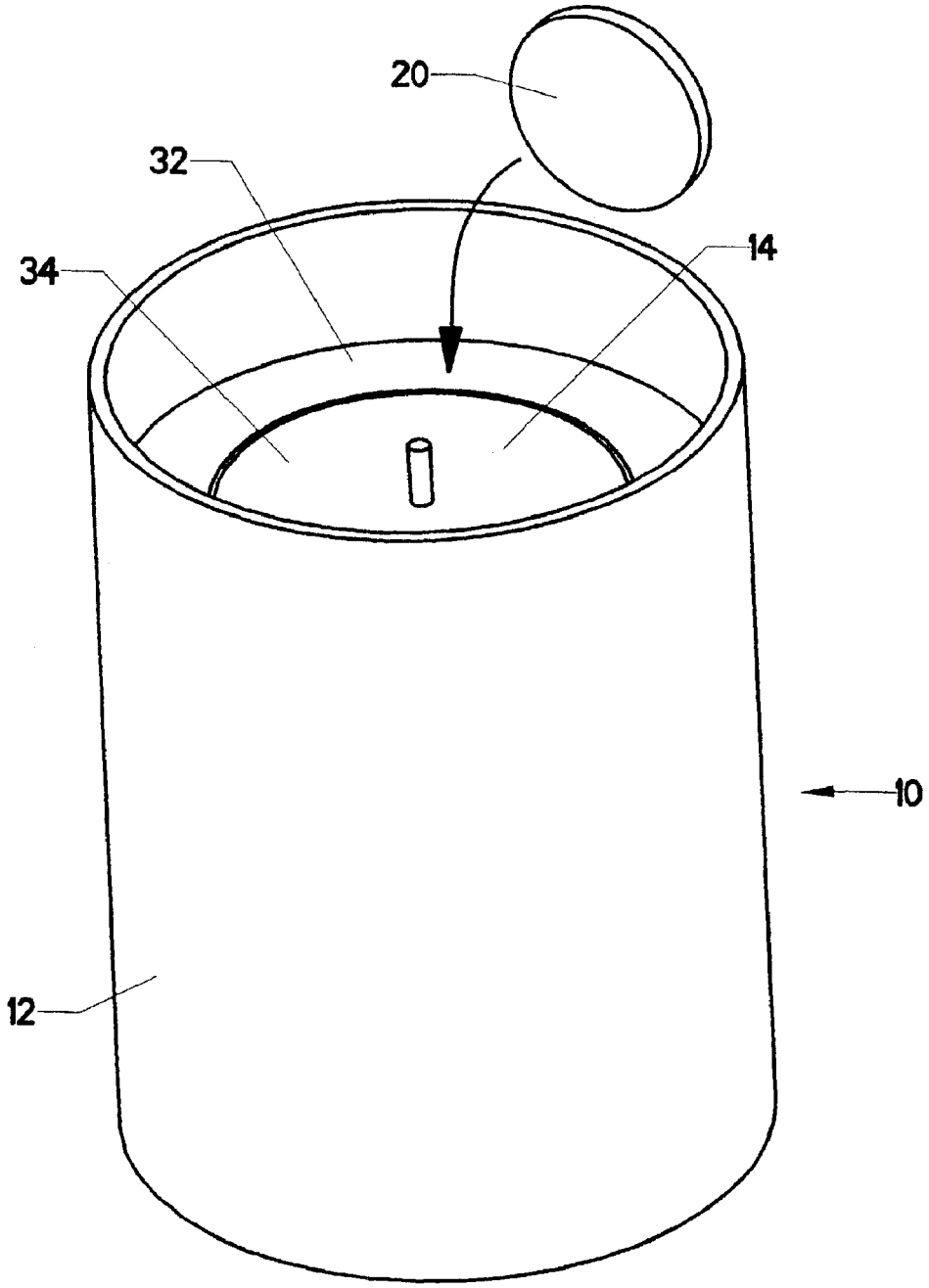
FIG. 5 is an isometric view, showing the insertion of a personalizing object.

FIG. 5 shows still another method for inserting the personalizing object. Heat is applied to candle 10 (using the techniques described previously) in order to create a melted region 32 of fuel 14. Personalizing object 20 is then inserted into melted region 32 and allowed to sink to a desired depth. The candle is then cooled to solidify the fuel and once again create the configuration shown in FIG. 6.

Although FIG. 5 shows an annular melted region 32, corresponding to the application of uniform external heat, this need not be the case. A localized melted region 32 can be created along one wall using a heat gun. Likewise, melted region 32 can comprise all the fuel within the jar (although melting all the fuel is generally undesirable since it will require much more time to heat and cool).

Although personalizing objects having a density greater than the fuel have been discussed, those skilled in the art will realize that many personalizing objects may have a density greater than the fuel. For these objects, an insertion tool (such as a pair of tweezers) is used to push the object toward the bottom of the liquified fuel. The fuel is then cooled and solidified before the personalizing object floats to the top.

The invention allows a purchaser to select a premanufactured candle and then add a personalizing object. As an example, a purchaser may wish to buy a decorative candle as a birthday present. The purchaser first selects a candle (which may have a festive "birthday" scene already imbedded in the fuel). The purchaser then selects a personalizing object. Exemplary objects are metal disks, glass beads, small plaques, metal ribbons, etc. The personalizing object may have a message already printed thereon. As an alternative, the purchaser may be given the option of creating a message. This message is then etched or engraved (preferably using known automating machinery) onto the personalizing object. Some personalizing objects (such as small statues or religious symbols) may have no printed message.

Whatever personalizing object is selected, one of the insertion methods heretofore described is then used to insert the personalizing object into the candle. The purchaser then pays for and receives a unique candle according to his or her wishes.

Figure 7:
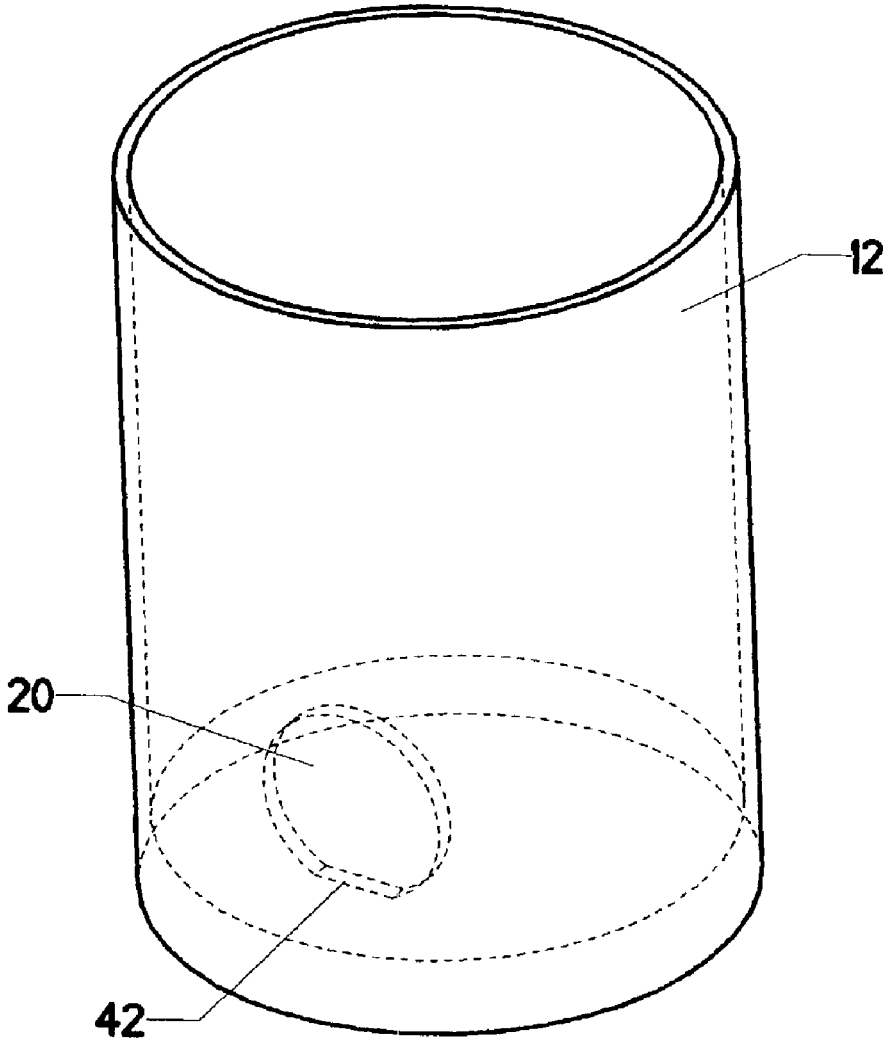
FIG. 7 is an isometric view, showing a personalizing object inserted during the manufacturing process.

Of course, a personalizing object can also be added during the original manufacturing process itself. FIG. 7 depicts one method of accomplishing this goal. Decorative candle manufacturing typically starts with jar 12 being empty. A wick, fuel, and decorative effects are then added. FIG. 7 shows personalizing object 20 adhered to the bottom of glass 12 via glue joint 42. In this process, the personalizing object is added to the empty glass. The fuel, wick, and other decorative effects (if desired) are then added after the adhesive on the personalizing object has set. Personalizing object 20 is thereby encapsulated in the completed candle. The same technique can be used to adhere the personalizing object to a side wall of the jar, using a fast-setting adhesive.

The preceding description contains significant detail regarding the novel aspects of the present invention. It is should not be construed, however, as limiting the scope of the invention but rather as providing illustrations of the preferred embodiments of the invention. Thus, the scope of the invention should be fixed by the following claims, rather than by the examples given.

Having described my invention, I claim:

1. A method for inserting an object into a candle, wherein said candle includes ajar containing a fuel, and wherein said fuel has an exposed upper surface, comprising:

a. using a blade to cut an incision into said exposed upper surface of said fuel of a depth sufficient to accommodate said object so that said object lies completely beneath said exposed upper surface;

b. placing said object into said incision;

c. heating said fuel proximate said incision to a temperature sufficient to liquify said fuel so that said fuel flows around said object and completely covers said object; and d. cooling said fuel proximate said incision to a temperature sufficient to solidify said fuel.

2. A method as recited in claim 1, wherein said fuel proximate said incision is heated be applying a heat source to said jar proximate said incision.

3. A method as recited in claim 2, wherein said heat source is a heat gun.

4. A method as recited in claim 1, wherein said fuel proximate said incision is heated by placing said candle in an oven.

5. A method as recited in claim 1, wherein said fuel proximate said incision is heated by placing said candle in a hot liquid bath.

6. A method as recited in claim 1, wherein said fuel proximate said incision is heated by placing said candle on top of a heat source.

* * * * *